US005165825A

United States Patent [19]

Wallin

[11] Patent Number: 5,165,825

[45] Date of Patent: Nov. 24, 1992

[54] ROCK BOLTING DEVICE

[75] Inventor: Per Wallin, Johanneshov, Sweden

[73] Assignee: Atlas Copco Construction and Mining Technique AB, Stockholm, Sweden

[21] Appl. No.: 790,372

[22] Filed: Nov. 12, 1991

[30] Foreign Application Priority Data

Dec. 3, 1990 [SE] Sweden ..... 9003826

[51] Int. Cl.[5] ..... E02D 20/02

[52] U.S. Cl. ..... 405/303; 405/259.6

[58] Field of Search ..... 405/259.1, 259.5, 259.6, 405/269, 303

[56] References Cited

U.S. PATENT DOCUMENTS

| | | | |
|---|---|---|---|
| 4,229,124 | 10/1980 | Frey et al. | 405/303 |
| 4,420,277 | 12/1983 | Hibbard et al. | 405/260 |
| 4,545,702 | 10/1985 | Sano et al. | 405/269 |
| 4,643,619 | 2/1987 | Issakainen | 405/303 |

*Primary Examiner*—David H. Corbin

*Attorney, Agent, or Firm*—Eric Y. Munson; Mark P. Stone

[57] ABSTRACT

Rock bolting device comprising a swingable bolting unit (2) which carries a conduit (4) for transport of hardenable mass to a drill hole (3). The conduit is surrounded by a tube (5) in which a thickened part (6) of the conduit is movable to-and-fro under sealing cooperation with the tube. Through this the conduit (4) can be fed towards or away from the mouth (7) of the drill hole (3).

1 Claim, 3 Drawing Sheets

ROCK BOLTING DEVICE

BACKGROUND OF THE INVENTION

The present invention relates to a rock bolting device in which a hardenable mass is entered into a drill hole in the rock.

In a prior art device of the above mentioned kind, see U.S. Pat No. 4,215,953, a hydraulic cylinder is used in order to feed a tube, for supply of hardenable mass, to or from the drill hole in the rock.

SUMMARY OF THE INVENTION

The present invention, which is defined in the subsequent claims, aims at achieving a device where the above mentioned hydraulic cylinder can be avoided. Through this two advantages are achieved, lower costs and lower weight of the bolting unit which is situated far away from the carrier. A further advantage which is obtained if the conduit for feeding hardenable mass to the drill hole is made of plastic or rubber is that the device becomes comparatively insensitive to side loads or other loads caused by caving or similar.

BRIEF DESCRIPTION OF THE DRAWINGS

An embodiment of the invention is described below with reference to the accompanying drawings in which.

DESCRIPTION OF THE BEST MODES FOR CARRYING OUT THE INVENTION

Figure 1:
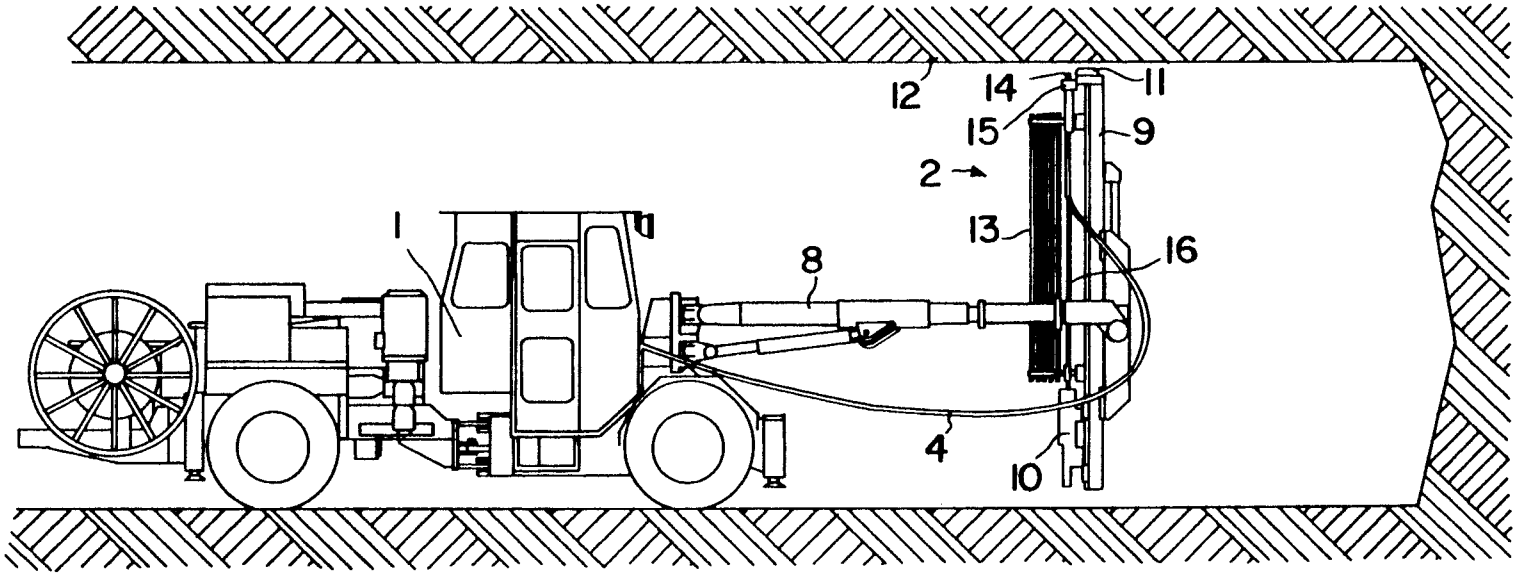
FIG. 1 shows a rock bolting device according to the invention.

The device shown in the drawings comprises a carrier 1 and a bolting unit 2 arranged on a boom 8 on the carrier. The bolting unit comprises a feed beam 9 along which a rock drilling machine 10 is movable to-and-fro. The feed beam is at its front end provided with a support 11 for contact with the rock 12. This contact defines an axis about which the bolting unit is turnable between a drilling position and a position for introduction of hardenable mass into the bore hole. The bolting unit comprises furthermore a magazine 13 for rock bolts. The device comprises a, not shown, storage for hardenable mass on the carrier. Hardenable mass is fed from the carrier 1 via conduit 4 to a nozzle 14 on the bolting unit 2. The bolting unit is provided with a swingable drill guide 15 which guides a drill string 16 connected to the rock drilling machine 10 and carries the nozzle 14. The conduit 4 shown in the drawings comprises at its front end two tube pieces 17,18 which are interconnected by means of a thickened part in form of a piston 6. This piston cooperates sealingly with a tube 5 surrounding conduit 4. Tube 5 is provided with two connections 19,20 for supply of pressure fluid, preferably water, to drive the piston 6 in one or the other direction in tube 5. Conduit 4, including tube pieces 17,18, is suitably made in some suitable plastic or rubber material. Conduit 4 can alternatively be a through conduit provided with a thickened part in form of a ring which is fastened by means of glueing, welding or in another suitable way.

Conduit 4 is provided with a loading tube 23 where cartridges 29 with hardenable material, e.g. plastic with hardener, can be supplied to conduit 4. Other materials can be used as hardenable material, e.g. a cement mixture, whereby the supply to conduit 4 is performed in another way. Conduit 4 is via a valve 22 connected to a compressed air source 21. Connections 19,20 are via valves 25,27 connected to a pressure fluid source 24, in the shown example a pressure liquid source. The connections are furthermore via valves 26,28 connected to low pressure.

Figures 2, 3, 4, 5:
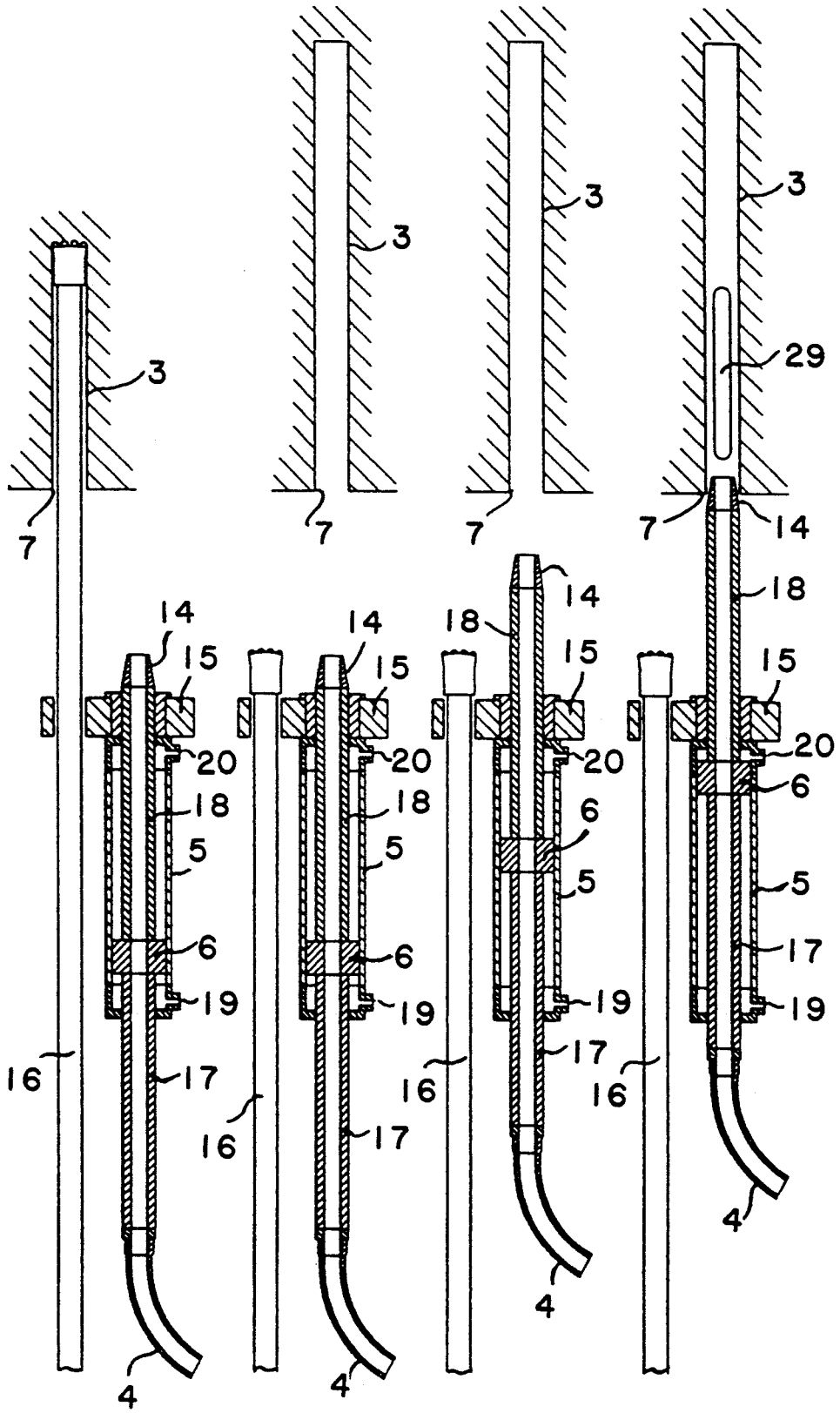
FIG. 2 shows a part of the device according to FIG. 1 during drilling of a hole in the rock.
FIG. 3 shows the device with the conduit for feeding in of hardenable mass in line with the drill hole.
FIG. 4 shows the device during feeding forward of the conduit towards the drill hole mouth.
FIG. 5 shows the device with the conduit at the drill hole mouth.
Figure 6:
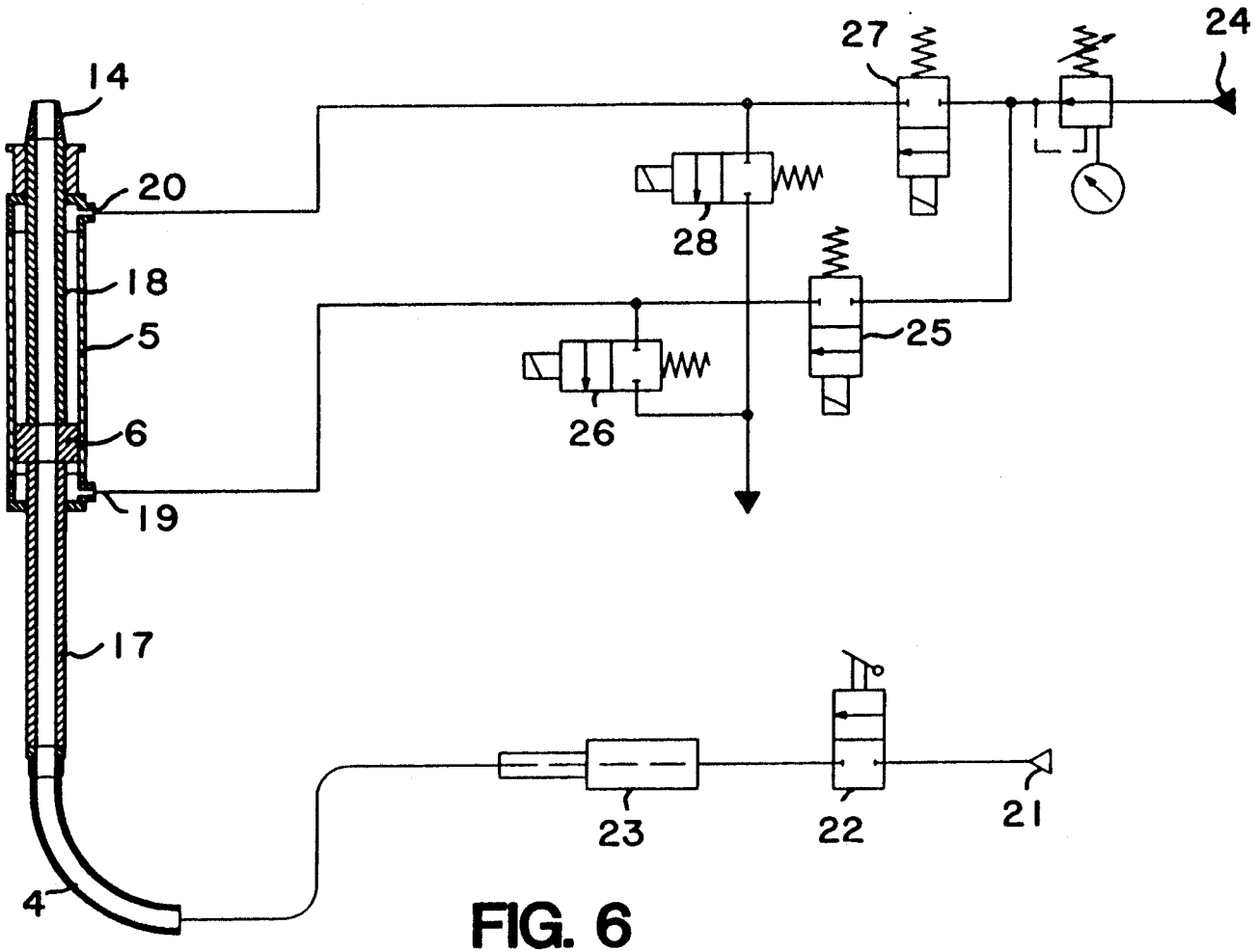
FIG. 6 shows a circuit diagram for the feeding of the conduit towards or from the rock.

The device shown in the drawings works in the following way. Support 11 is applied against the rock 12 after which the bolting unit 2 is turned to the position shown in FIG. 2. Hole 3 is drilled. Then the drill string 16 is returned and the bolting unit 2 is swung to the position shown in FIG. 3. Valves 25 and 28 are opened so that nozzle 14 is displaced towards the drill hole mouth 7 via the position in FIG. 4 to the position in FIG. 5. One or more cartridges 29 with hardenable mass is introduced into loading tube 23 after which valve 22 is opened so that the cartridges are introduced into bore hole 3. Then valves 22, 25 and 28 are closed. Valves 27 and 26 are opened so that conduit 4 is returned. The bolting unit 2 is swung away so that a rock bolt can be entered into bore hole 3. On doing so cartridges 29 are crushed so that plastic and hardener come into contact with each other so that the hardening starts.

I claim:

1. Rock bolting device comprising a carrier (1), a bolting unit (2) arranged on the carrier, said bolting unit being movable between a drilling position and a position for feeding hardenable mass into a drill hole (3), said bolting unit carrying a conduit (4) for transporting said hardenable mass to the drill hole, said bolting unit (2) further comprising a tube (5) surrounding said conduit (4), said conduit being provided with a thickened part (6) which by means of applied fluid pressure is reciprocably movable in said tube under sealing cooperation with the tube such that the conduit is displaceable towards or away from a mouth of said drill hole (3).

* * * * *